US007065223B2

(12) United States Patent
Westerkull

(10) Patent No.: US 7,065,223 B2
(45) Date of Patent: Jun. 20, 2006

(54) HEARING-AID INTERCONNECTION SYSTEM

(76) Inventor: Patrik Westerkull, Hovashagstig 26A, 436 54 Hovas (SE)

( * ) Notice: Subject to any disclaimer, the term of this patent is extended or adjusted under 35 U.S.C. 154(b) by 16 days.

(21) Appl. No.: 10/937,165

(22) Filed: Sep. 9, 2004

(65) Prior Publication Data

US 2006/0050913 A1 Mar. 9, 2006

(51) Int. Cl.
*H04R 25/00* (2006.01)

(52) U.S. Cl. ..... 381/326; 381/151; 600/25

(58) Field of Classification Search ..... 381/151, 381/326, 329; 600/25, 426; 607/55, 56, 607/57

See application file for complete search history.

(56) References Cited

U.S. PATENT DOCUMENTS 4,498,461 A 2/1985 Hakansson
5,735,790 A 4/1998 Hakansson et al.
6,073,044 A * 6/2000 Fitzpatrick et al. ..... 600/426

FOREIGN PATENT DOCUMENTS

EP 0996391 12/1998

* cited by examiner

*Primary Examiner*—Sinh Tran
*Assistant Examiner*—Brian Ensey
(74) *Attorney, Agent, or Firm*—Rolf Fasth; Fasth Law Offices

(57) ABSTRACT

The hearing-aid interconnection system has a skin-penetrating hearing-aid abutment (2) and a fixture (4) anchored in a skull bone (6). A first press fit is formed between a first contact surface (8*a*) of the abutment and a first fixture contact surface (10*a*) of the fixture. The first abutment contact surface extends around the first fixture contact surface. A second press fit is formed between a second contact surface (8*b*) of the abutment and a second fixture contact surface (10*b*) of the fixture. The second fixture contact surface extends around the second abutment contact surface.

13 Claims, 8 Drawing Sheets

HEARING-AID INTERCONNECTION SYSTEM

TECHNICAL FIELD

The present invention relates to a hearing-aid interconnection system between a bone anchored fixture and a skin penetrating hearing aid abutment.

BACKGROUND OF THE INVENTION

Bone anchored hearing aids are essential for the rehabilitation of patients suffering from hearing losses for which traditional hearing aids are insufficient. The most common type of such devices consists of an external hearing aid with a vibrating transducer which, through a coupling, is connected to a skin-penetrating abutment which has an interconnection to a screw shaped fixture anchored in the skull bone. The fixture is usually made of titanium and is usually designed with a flange to prevent the fixture from being pushed through the skull bone in case of a sudden accidental impact. The surgery for anchoring the fixture and the abutment is often done in one stage where the fixture and the abutment are inserted at the same time. However, for some patients it is necessary to do a two stage surgical procedure where the fixture is inserted in the bone and then left to integrate with the bone for 3 months before the skin penetration is done and the abutment is attached. Since this kind of concept includes a permanent skin penetration a significant number of these patients have problems with skin infections due to bacterial growth in the area.

The abutment can either be mounted on the fixture with a small connection screw going through the center of the abutment and into a threaded hole in the fixture. Alternatively, the abutment and fixture can be manufactured in one single piece of material.

The connection between the fixture and the abutment is of critical importance for the clinical function of this kind of product system. If the abutment and fixture is integrated and manufactured from one piece of material, it is not possible to separate the abutment portion from the fixture portion without machining the material with precision drills etc. Such metal machining procedures are not desirable in a clinical situation. It is important to have the possibility to remove the abutment in case it has been damaged and need to be changed or if the skin-penetrating abutment should just be removed from the patient. If the fixture and the abutment are manufactured in one piece it is also not possible to optimize the material choice for the fixture and the abutment separately. Another drawback with conventional designs is that it is not possible to do the surgery in a two stage surgical procedure that is necessary for some patient groups.

The alternative to the integrated design is to have a separate abutment mounted on the fixture with a small connection screw going through the center of the abutment and into a threaded hole in the fixture. The abutment rests on a planar surface on the fixture and is kept in place only by the connection screw. Since the surfaces are usually normal machined surfaces there will always be small gaps in the interface between the abutment and the fixture. In such gaps bacteria can grow and also be transported from the inside of the abutment to the skin penetration area, which may result in an increased risk for infections in the skin penetrating area. A common problem with conventional designs is also that the connection screw and the abutment sometimes comes loose which causes both poor sound quality and an increased risk for skin infections. The connection screw is a quite expensive component since it is often made of a gold alloy.

Another current problem causing skin irritation is the fact that often the skin around the abutment, which has been thinned down to a skin thickness of around 1 mm during surgery, grows with time in the lateral direction around the abutment. For the current designs there is nothing that hinders the skin from growing thicker around the abutment as time goes by. Thick skin around the abutment significantly increases the risk for skin infections. There is a need for a hearing aid system that does not have the above-outlined drawbacks.

SUMMARY OF THE INVENTION

The interconnection system of the present invention provides an effective solution to the above-outlined problems of previous designs of interconnections between hearing aid abutments and bone anchored fixtures. The presented interconnection can be used in combination with any type of coupling between the abutment and the hearing aid.

The interconnection of the present invention includes at least one press fit between the abutment and the fixture. The press fit is circular in its geometry since this offers a cost efficient manufacturing of the components as well as a possibility to position the abutment in any rotational position in relation to the fixture. With a press fit it is here meant a fit where there are forces acting in radial direction between two components connected to each other, and where the forces are mainly caused by the elasticity of at least one of the components. This definition includes for example classical press fittings between a cylindrical body that has been pressed into cylindrical hole of a slightly smaller diameter than the cylinder and where the cylindrical body might be kept very firmly in position in the hole. However, the definition of press fit used here includes also for example a fit between a component having a male conical portion that is seated into a female conical portion of another component and where for example a connection screw is needed to keep them together and to generate the radial forces between the two conical portions of the two components.

There are several advantages with the press fit interconnection. The press fit prevents the abutment from moving sidewise or rotating easily in relation to the fixture.

The press fit also seals the interconnection between the abutment and the fixture so that the possibilities for bacteria to grow in small gaps between the fixture and the abutment are significantly reduced. Also, the possibilities for bacteria to pass from the inside of the abutment via the interconnection to the skin penetrating area are hindered by this sealing.

The interconnection can be designed to include a press fit where part of the fixture goes inside of a portion of the abutment so that the press fit is created by an abutment contact surface extending around a fixture contact surface and where the contact surfaces are in contact with each other when the abutment is seated on the fixture. This kind of press fit can be useful when the press fit should specifically act as a sealing of the periphery of the interface between the abutment and the fixture. The periphery of the interface between the abutment and the fixture is the part of the interface being closest to the skin surrounding the abutment.

Alternatively, the interconnection can be designed to include a press fit where instead part of the abutment goes inside of a portion of the fixture so that the press fit is created by a fixture contact surface extending around an abutment contact surface and where the contact surfaces are in contact with each other when the abutment is seated on the fixture. This kind of press fit can for example be useful when the press fit should specifically act as a firm press fit between the abutment and the fixture since this press fit may be easier to extend more in axial direction thus giving a greater press fit contact surface between the abutment and the fixture.

The interconnection can also be designed to include both of the above press fit alternatives. This arrangement can be a useful alternative when both a firm press fit connection between the fixture and the abutment as well as a press fit sealing in the periphery of the interface between the abutment and the fixture is preferred.

A press fit is preferably done between two conical or cylindrical surfaces. The angle of two contact surfaces that is in contact with each other may be chosen so that the tightest press fit is achieved at the most peripheral part of a contact surface so that a sealing is achieved closest to the skin which further reduces the risk for gaps in the interface where bacteria could be accommodated and then interfere with the skin tissue.

In a preferred embodiment at least one of the contact surfaces has an axial angle greater than 0 degrees and smaller than 30 degrees. Usually the angle would be chosen to be ≧0 degrees but it is also possible to have a contact surface with an angle less than 0 degrees. The advantage of having and angle that is ≧0 degrees, is that the press contact and the sealing will be located to a more peripheral portion of the interface between the fixture and the abutment without offering gaps for bacteria. Preferably, the angle should be less than 30 degrees to accomplish a sufficient sealing pressure between the abutment and the fixture. The axial angle of the contact surface on the abutment has however to be in matching relationship with the axial angle of the contact surface on the fixture, otherwise there might be no press fit between the fixture and the abutment.

A non-matching relationship might for example result in a fit where the abutment initially is hard to press down on to the fixture but where the abutment then gets fully loose around the fixture when it has been fully pressed down on to the fixture. The choice of the actual angles that represent a matching relationship is for example also depending on the measures and elasticity of the material in the abutment and fixture. The angle, measures and material of the contact surfaces may be either chosen so that a quite firm press fit between the abutment and the fixture is achieved or so that the abutment can be more easily removed from the fixture.

At least one of the contact surfaces can preferably have a circular geometry. To get a firm press fitting and to get a long inner thread in the fixture it is advantageous to have a significantly protruding portion in the lateral end of the fixture. To accommodate the protruding fixture portion the depth of the abutment cavity is specifically greater than 1 mm in one of the preferred embodiments.

In another preferred embodiment the protruding fixture portion includes a male hexagonal geometry which can be used both when attaching instruments for handling and inserting the fixture and, in case the abutment cavity facing the fixture is designed with a corresponding female hexagonal geometry, the fixture can be locked from rotation in relation to the abutment, which can be useful if a counter torque instrument is attached to the abutment when the connection screw is tightened. By applying counter torque when tightening the connection screw the tightening torque is not transferred to the fixture in the bone that means the forces on the sensitive bone-fixture interface is reduced.

The press fit can then be designed so that the abutment can still quite easily be removed from the fixture anchored in the bone. In a preferred embodiment, the interconnection includes a connection screw that goes through the abutment and into a threaded hole in the fixture and keeps the fixture and the abutment in a connected position. The press fit can then be designed so that the abutment can quite easily be removed from the fixture after the connection screw has been removed. In this way, it is possible to easily remove or change the abutment, if necessary. With this embodiment the press fit significantly reduces the risk for the connection screw to come loose.

The press fit can also be designed so that the press fit itself is sufficiently strong to keep the fixture and the abutment together without a connection screw being needed. In this way, the design is made simpler and more cost efficient since there is no cost for a connection screw. It may still however be possible to separate the abutment from the fixture with a special instrument, similar to a puller, and it may still be possible to fit a new abutment on the fixture. The fixture may still have an internal thread to receive an abutment with a connection screw although this internal thread was not initially used. When the press fit is used without a connection screw the internal hole that can receive a connection screw may be protected by a cover plug or cap to avoid dirt to be collected in the hole.

With the present invention, the surgery can either be done in a one-stage surgical procedure or in a two-stage surgical procedure. In case of a one stage surgical procedure, it is possible to have the abutment and the fixture mounted together from the manufacturing so that the abutment and fixture can be inserted as one unit during surgery. For a two stage surgical procedure, the abutment is preferably connected to the fixture with the aid of a connection screw.

The interconnection may also include an elastic material, such as plastic or silicone, to further add to the sealing of the interconnection. To minimize the risk for micro gaps in the interconnection this sealing is preferably placed in the peripheral portion of the interface between the abutment and the fixture, i.e. the portion closest to the skin.

In a preferred embodiment, the abutment end closest to the fixture has a narrow portion around which the skin is intended to be positioned. The abutment also has a middle portion that has a significantly greater average diameter than the narrow portion. A significantly greater average diameter of the middle portion should here typically be at least 1 mm greater than the average diameter of the narrow portion. The portion between the narrow portion and the middle portion is the transition portion. The expression average diameter is used since the narrow portion, the transition portion and the middle portion might for example have oval geometries although circular geometries are likely to be the preferred geometry.

The transition portion between the narrow portion and the middle portion forms a smooth edge that prevents the skin from growing up along the abutment in lateral direction. In this way, the risk for skin infections is further reduced. The transition portion presents an edge portion where the axial angle of the transition portion is at its maximum. The edge portion has an axial angle that is greater than 45 but smaller than 120 degrees. The optimal choice of the axial angle of the edge portion might for example differ between different patient groups. The smaller angle can be used if a very smooth and less distinct edge is preferred and it is then easier to clean under the edge. A greater angle may be chosen if a more distinct edge is preferred and it will then be more difficult for the skin to pass the edge in lateral direction.

When the abutment is connected to the fixture, the distance between the center of the edge portion and the contra lateral side of the fixture flange should be greater than 0.8 mm so that the thinned skin can go under it and it should be less than 4.5 mm since the skin under the edge should not be thicker than that. The thickness of the flange is preferably chosen to be between 0.3 to 1.5 mm and the thickness of the skin around the abutment may vary between 0.5 to 3 mm.

The contra lateral side of the flange has been chosen as the reference here since this side is likely to be more flat and well defined than the lateral side of the flange that might include several conical surfaces. This design can also be applied to an abutment with any hearing aid coupling type or to any type of interconnection between a hearing aid abutment and a fixture.

DETAILED DESCRIPTION

Figure 1:
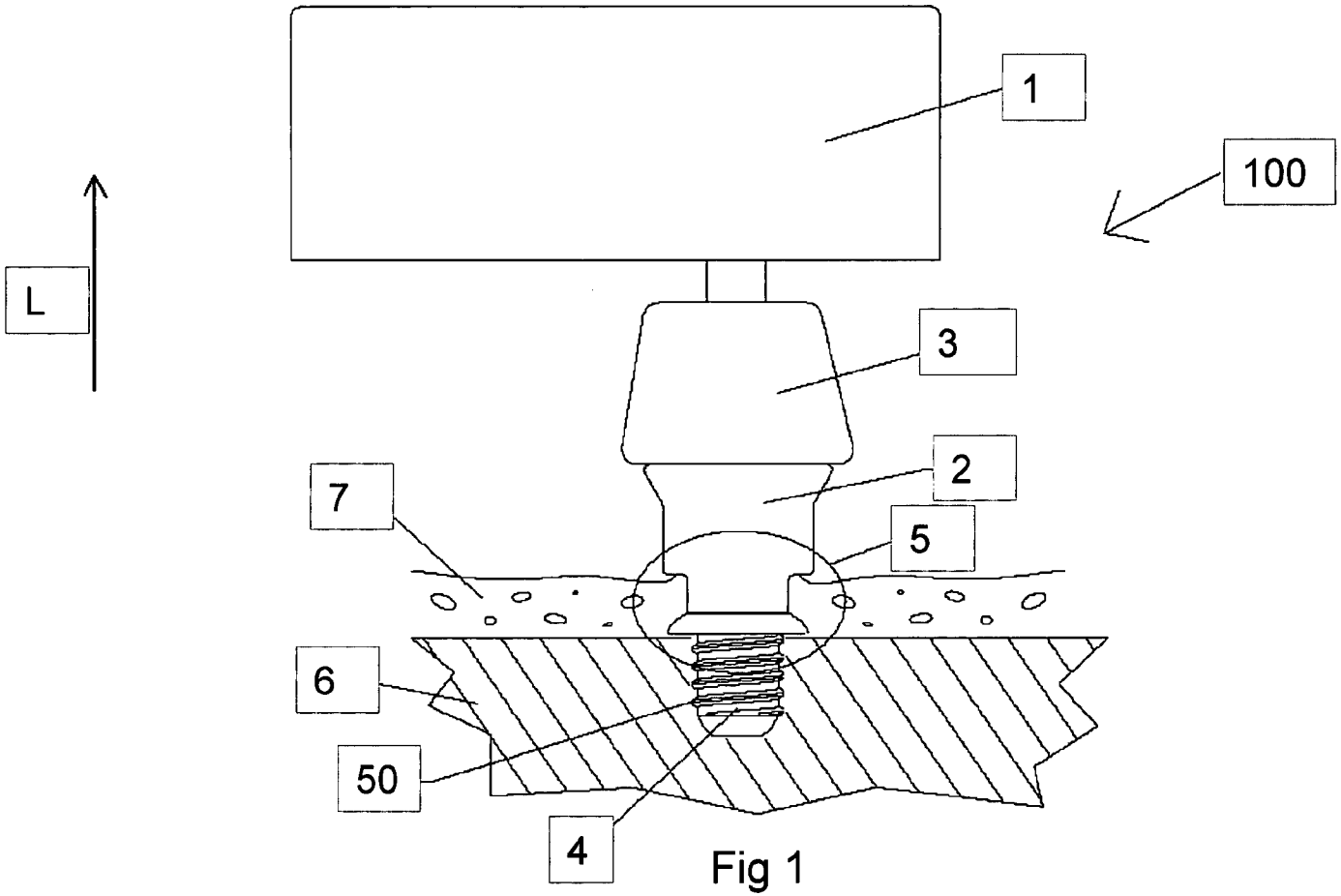
FIG. 1 is an overview of a bone anchored hearing aid system with a hearing aid which is connected to a hearing aid abutment via a coupling and where the hearing aid abutment goes through the skin and has an interconnection to a fixture anchored in the skull bone.

FIG. 1 shows an overview of a bone anchored hearing aid system 100 of the present system. A hearing aid device 1 is connected to a hearing aid abutment 2 via a coupling 3. The coupling may be removably connected to the abutment 2 and to the hearing-aid device 1. The abutment 2 is connected to a fixture 4 via an interconnection 5. The fixture may have a threaded portion 50 that is anchored in the skull bone 6. The abutment 2 may go through the skin 7. When the system 100 is properly mounted to a skull bone 6, vibrations are transmitted from the hearing aid device 1 to the skull bone 6 and the patient can then hear via bone conduction. A lateral direction may be defined by the arrow (L) that is parallel to an axial direction of the interconnection.

Figure 2:
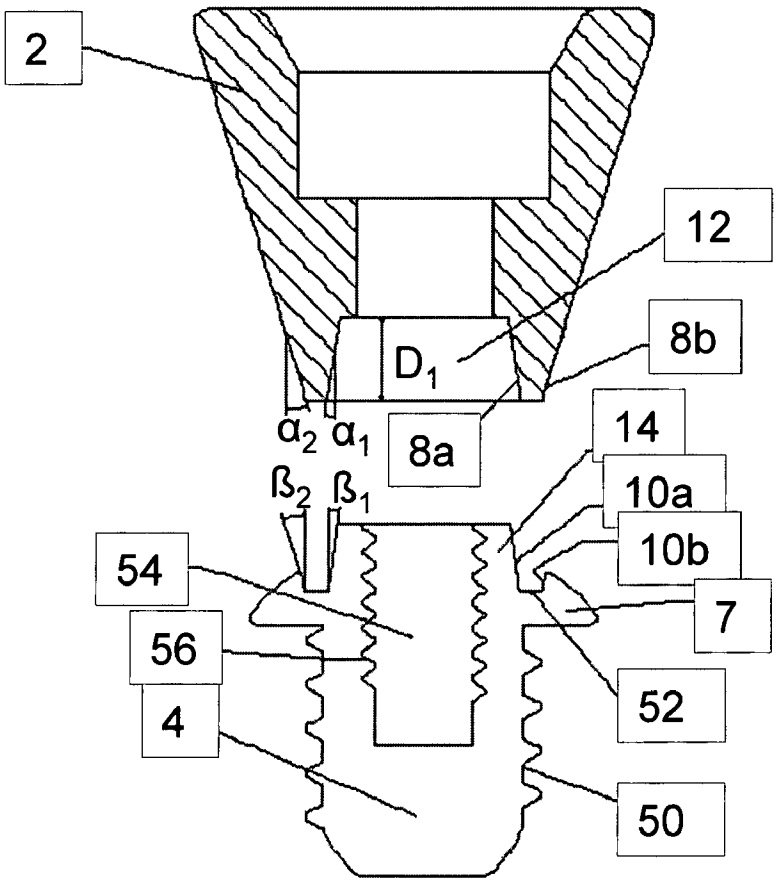
FIG. 2 is a cross-sectional side view of a separated hearing aid abutment and fixture for a preferred embodiment where the design includes contact surfaces for two press fittings.

FIG. 2 is a cross-sectional side view of a separated hearing aid abutment 2 and a fixture 4 of a preferred embodiment. The fixture 4 has an outwardly protruding flange 7 that has a circular upper cavity 52 defined therein by contact surfaces 10*a* and 10*b*. The threaded portion 50 is disposed below the flange 7. The fixture 4 may also have an upper centrally positioned axial bore 54 defined therein. The bore 54 may have an internal thread 56.

The abutment 2 may be conical shaped and have contact surfaces 8*a* and 8*b* that may be pressed into the cavity 52 and against the fixture contact surfaces 10*a* and 10*b* respectively, when the abutment is pressed down on into the fixture 4. Preferably, the contact surfaces 8*a*, 8*b*, 10*a*, 10*b* have circular geometry. The contact surface 8*a* has an axial angle $\alpha_1$ and the contact surface 8*b* has an axial angle $\alpha_2$. The angle $\alpha_1$ may be equal to $\alpha_2$, or the angle $\alpha_1$ may differ from the angle $\alpha_2$. The contact surfaces 10*a* has an axial angle $\beta_1$ and the contact surface 10*b* has an axial angle $\beta_2$. The angle $\beta_1$ may be equal to the angle $\beta_2$, or the angle $\beta_1$ may differ from the angle $\beta_2$. The angle $\alpha_1$ may be equal to the angle $\beta_1$, or the angle $\alpha_1$ may differ from the angle $\beta_1$. The angle $\alpha_2$ may be equal to the angle $\beta_2$, or the angle $\alpha_2$ may differ from the angle $\beta_2$.

When the abutment 2 is pressed into the fixture 4 there is a press fit created both due to the tight contact between the contact surface 8*a* and the contact surface 10*a* and due to the tight contact between the contact surfaces 8*b* and the contact surface 10*b*. The abutment has a conical cavity 12 defined therein to receive a conical protruding fixture portion 14 of the fixture 4. The abutment 2 has a cavity 12 defined therein with a depth $D_1$.

In FIG. 2 the values of the angles may be so that the angle $\alpha_1$=9 degrees, $\alpha_2$=17 degrees, $\beta_1$=7.5 degrees and $\beta_2$=17 degrees, i.e. the angles are defined so that all of these axial angles $\alpha_1$, $\alpha_2$, $\beta_1$ and $\beta_2$ have positive values in FIG. 2. Of course, other suitable angles may be used.

Figure 3:
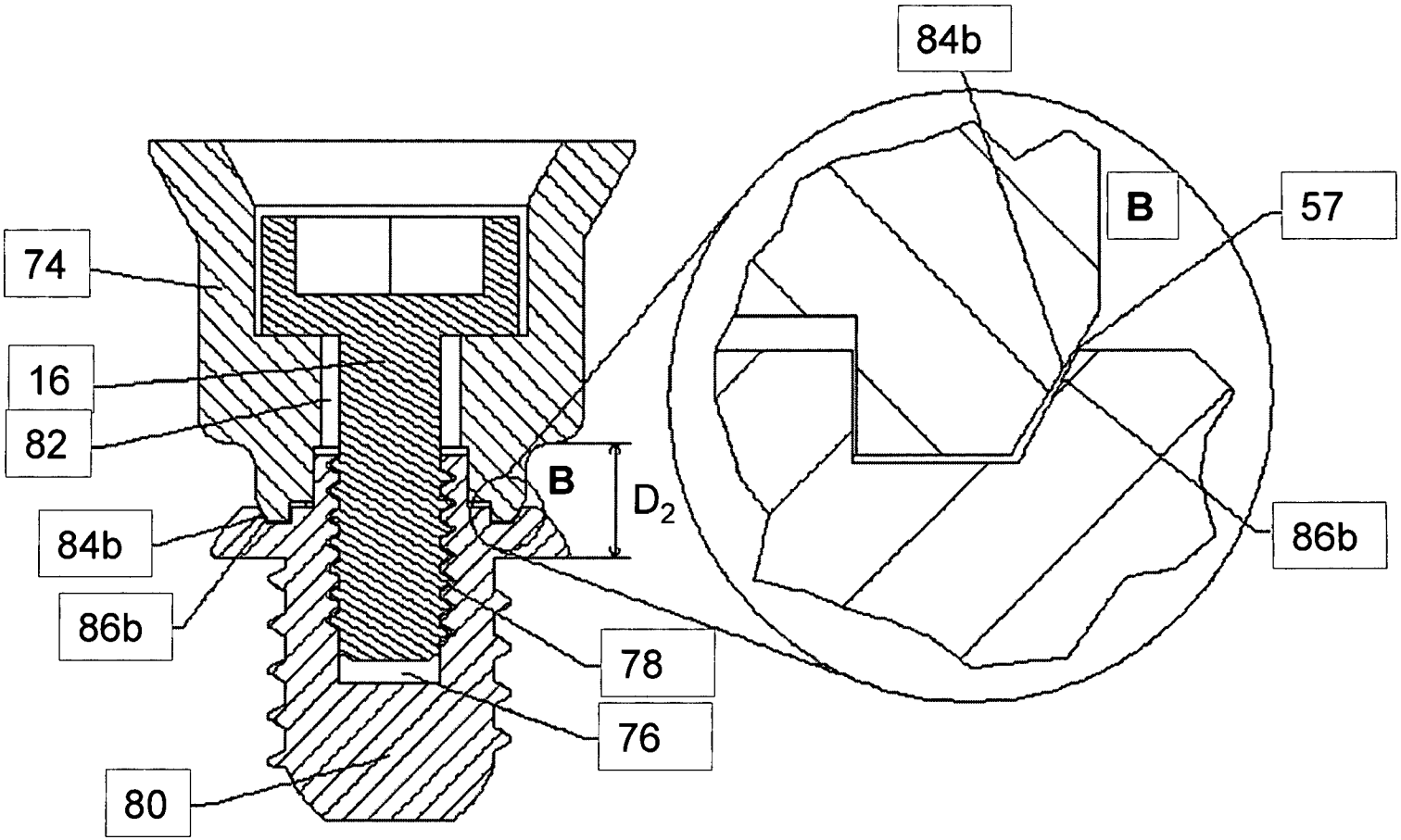
FIG. 3 is a cross-sectional side view of a hearing aid abutment, a connection screw and a fixture for a preferred embodiment where the design includes a press fit where the contact surface of the fixture goes around the contact surface of the abutment.

FIG. 3 is a cross-sectional side view of the hearing aid abutment 74 that has a connection screw 16 screwed into the bore 76 to engage the threads 78 of a fixture 80. The connection screw 16 is used to keep the fixture 80 and the abutment 74 together. The abutment has a through hole 82 defined therein to receive and hold the connection screw 16 inside the abutment so that a threaded portion of the screw 16 protrudes outside the abutment 2. In this embodiment, there is only one press fit between the fixture 80 and the abutment 74. The press fit may be achieved by an contact surface 84*b* of the abutment 74 having an axial angle $\alpha_2$, pressing against a contact surface 86*b* having an axial angle $\beta_2$ on the fixture 80. The enlargement section (B) of the FIG. 2 shows that the press fit has in this case been designed with the angle $\alpha_2$ greater than the angle $\beta_2$ so that the press fit is tightest in a most peripheral part 57 of the interface between the contact surface 84*b* of the abutment 74 and the contact surface 86*b* of the fixture 80.

Figure 4:
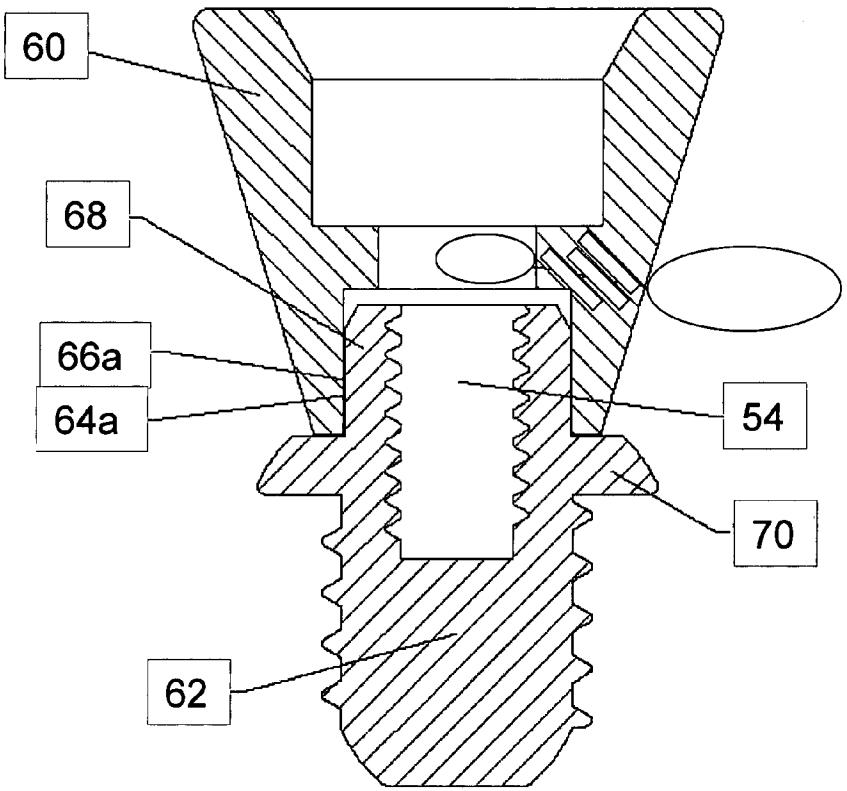
FIG. 4 is a cross-sectional side view of a hearing aid abutment and fixture for a preferred embodiment where the design includes one firm press fit where the contact surface of the abutment goes around the contact surface of the fixture.

FIG. 4 is a cross-sectional side view of an alternative embodiment of an abutment 60 and a fixture 62 with a flange 70 where the press fit is done with larger contact surfaces 64*a* and 66*a* between the fixture 62 and the abutment 60. The protruding portion 68 of the fixture has therefore been made longer than in the embodiment illustrated in FIG. 2. In this way, a press fit has been made so firm that the press fit itself keeps the abutment 60 fixed to the fixture 62. There is no connection screw 16 needed to keep the abutment 60 and the fixture 62 together when these are in use on a patient. There is therefore no need for the bore 54 either and this may be removed.

Figure 5:
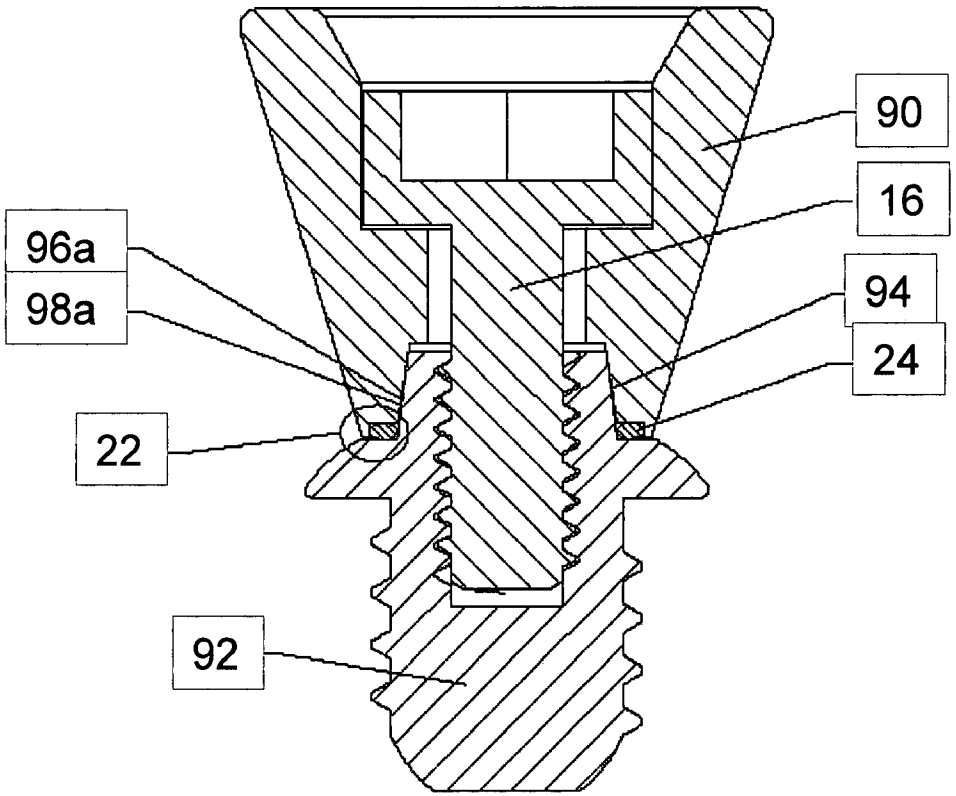
FIG. 5 is a cross-sectional side view of a hearing aid abutment, connector screw and fixture for a preferred embodiment where an elastic seal is positioned in the interface between the abutment and the fixture.

FIG. 5 is a cross-sectional side view an abutment 90 attached to a fixture 92. A peripheral portion 22 of an abutment-fixture interface 94 includes an elastic sealing 24. The abutment 90 has a contact surface 96*a* and the fixture 92 has a contact surface 98*a* that is part of the interface 94.

Figure 6:
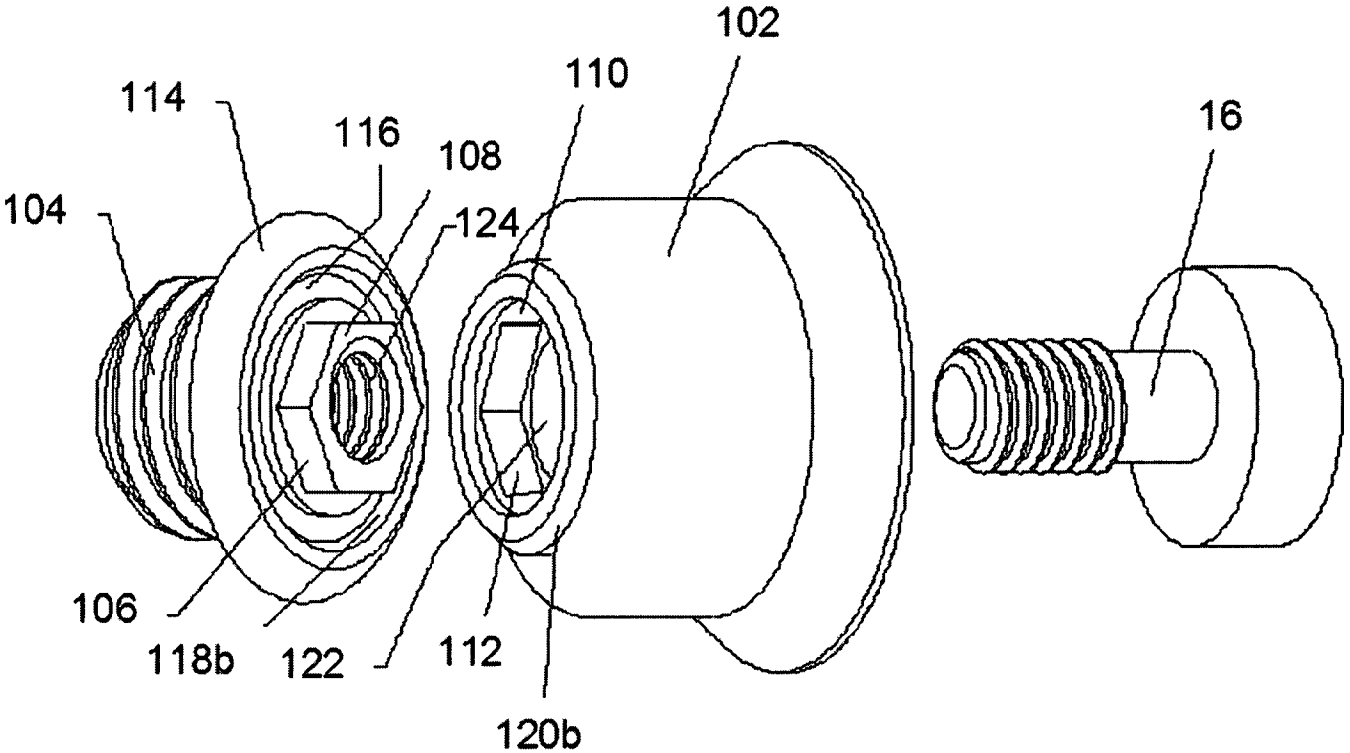
FIG. 6 is an exploded perspective view of a hearing aid abutment, connector screw and fixture for an embodiment with a hexagonal fitting between of the abutment and the fixture.

FIG. 6 is an exploded perspective view of a hearing aid abutment 102, connector screw 16 and fixture 104 where there is a hexagon 106 on the outer surface of the protruding portion 108 of the fixture 104. The abutment cavity 110 has a hexagonal inside 112 so that it fits on the fixture 104. A flange 114 of the fixture 104 has a groove 116 with a conical contact surface 118*b*. A press fit is achieved when the contact surface 120*b* of the abutment 102 is pressed down against the contact surface 118*b*. The connection screw 16 tightens the abutment 102 to the fixture 104 when it is inserted through an abutment through-hole 122 and screwed into a threaded hole 124 in the fixture 4. The through-hole 122 is best seen in FIG. 7.

Figure 7:
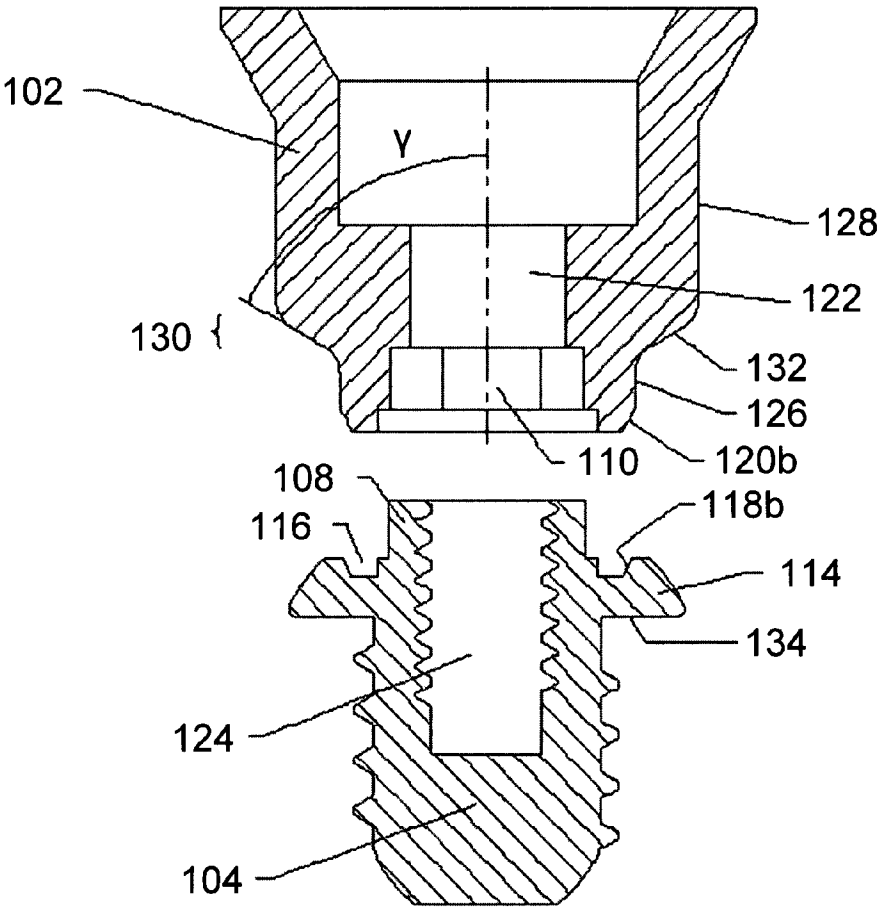
FIG. 7 is a cross-sectional side view of the embodiment in FIG. 6 where the abutment portion, closest to the fixture, includes a narrow portion and where there is a transition portion between the narrow portion and the middle portion of the abutment.
Figure 8:
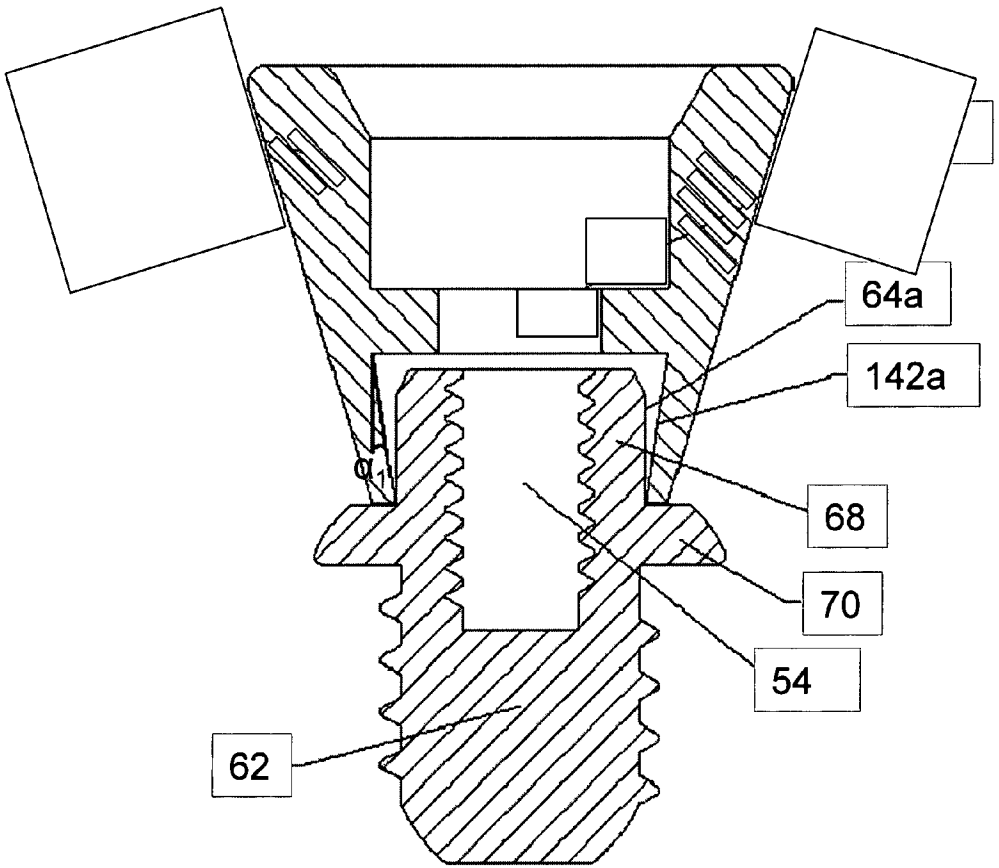
FIG. 8 is a cross-sectional side view of a hearing aid abutment and fixture for a preferred embodiment where the design includes a press fit where the contact surface of the abutment goes around the contact surface of the fixture and where the angle of the contact surface of the abutment is a negative angle.

FIG. 7 is a cross-sectional side view of the same embodiment as shown in FIG. 6 but where the cover screw 16 has been removed. The abutment 102 has a narrow portion 126 that is close to the fixture flange 114 when the abutment 102 is seated on the fixture 104. The abutment 102 has also a middle portion 128. There is a transition portion 130 between the narrow portion 126 and the middle portion 128. The transition portion 130 has an edge portion 132 that represents the maximum axial angle $\gamma$ of the transition portion 130. There is a distance $D_2$ between the center of the edge portion 132 and a contra lateral side 134 of the fixture flange 114, when the abutment 102 is seated on the fixture 104, as best seen in FIG. 3. FIG. 8 shows a similar embodiment as shown in FIG. 4 but here the axial angle $\alpha_1$ has a negative value at a contact surface 142*a*. The present invention is not limited to any specific design of other parts of a bone anchored hearing aid system.

For all of the above embodiments several alternative designs and combinations are possible and the invention is not limited to the preferred embodiments presented above. While the present invention has been described in accordance with preferred compositions and embodiments, it is to be understood that certain substitutions and alterations may be made thereto without departing from the spirit and scope of the following claims.

The invention claimed is:

1. A hearing-aid interconnection system, comprising:

a fixture anchored in a skull bone;

a skin-penetrating hearing-aid abutment penetrating a skin;

a removable coupling having one end removably connected to a lateral side of the skin-penetrating hearing-aid abutment and a second opposite end connected to a hearing aid apparatus;

the fixture having a conical attachment at a lateral end;

the abutment having a conical attachment at a contra lateral end; and a press fit between the conical attachment of the fixture, and the conical attachment of the abutment, the press fit having a circular geometry and providing a tight conical fit between the fixture and the abutment.

2. A hearing-aid interconnection system, comprising:

a skin-penetrating hearing-aid abutment and a fixture anchored in a skull bone;

a press fit between the fixture, having a conical-shaped end, and the abutment, having a conical-shaped end, the press fit having a circular geometry and providing a tight conical fit between the fixture and the abutment; and wherein the press fit contact surfaces on the fixture and the abutment have angles ($\alpha$) and ($\beta$) where 0 degrees $\leftarrow\alpha\leqq 30$ degrees and 0 degrees $\leftarrow\beta\leqq 30$ degrees.

3. The hearing-aid interconnection system according to claim 1, wherein a first press fit is formed between a first contact surface of the abutment and a first fixture contact surface of the fixture, the first abutment contact surface extending around the first fixture contact surface.

4. The hearing-aid interconnection system according to claim 3, wherein the first fixture contact surface has an angle ($\beta_1$) and the first abutment contact surface has an axial angle ($\alpha_1$) where 0 degrees $\leqq \beta \leqq 30$ degrees and 0 degrees $\leqq\alpha_1 \leqq 30$ degrees and where ($\alpha_1$) and($\beta_1$) are in matching relationship with another.

5. The hearing-aid interconnection system according to claim 2, wherein a second press fit is formed between a second contact surface of the abutment and a second fixture contact surface of the fixture, the second fixture contact surface extending around the second abutment contact surface.

6. The hearing-aid interconnection system according to claim 5, wherein the second fixture contact surface has an angle ($\beta_2$) and the second abutment contact surface has an axial angle ($\alpha_2$) where 0 degrees $\leqq \beta_2 \leqq 30$ degrees and 0 degrees $\leqq\alpha_2\leqq 30$ degrees and where ($\alpha_2$) and ($\beta_2$) are in matching relationship with another.

7. The hearing-aid interconnection system according to claim 1, wherein a depth ($D_1$) of an abutment cavity is adapted to receive a protruding fixture portion, the depth ($D_1$) being greater than 1 millimeter.

8. The hearing-aid interconnection system according to claim 7, wherein at least one of the protruding fixture portion and the abutment cavity has a hexagonal geometry.

9. A hearing-aid interconnection system, comprising:

a skin-penetrating hearing-aid abutment and a fixture anchored in a skull bone;

a press fit between the fixture, having a conical-shaped end, and the abutment, having a conical-shaped end, the press fit having a circular geometry and providing a tight conical fit between the fixture and the abutment; and wherein a connection screw maintains the fixture and the abutment in a connected position, and where the abutment has a through-hole defined therein and the fixture has a matching threaded hole to receive the connection screw.

10. The hearing-aid interconnection system according to claim 2, wherein a portion between the abutment and the fixture has an elastic sealing device disposed therebetween.

11. The hearing-aid interconnection system according to claim 2, wherein the abutment has a narrow portion and a middle portion, the middle portion has an average diameter which is significantly greater than an average diameter of the narrow portion, the abutment has a transition portion having an edge portion that has a maximum axial angle ($\gamma$) on the transition portion and where 45 degrees < ($\gamma$) <120 degrees.

12. The hearing-aid interconnection system according to claim 11, wherein the middle portion, the narrow portion, the transition portion and the edge portion have a circular geometry.

13. The hearing-aid interconnection system according to claim 11, wherein the system has an axial distance ($D_2$) between the edge portion of the abutment and a contra lateral side of the fixture flange so that the axial distance ($D_2$) is in the range 0.8mm < $D_2$ < 4.5 millimeters when the abutment is connected to the fixture.

* * * * *